US007083307B2

(12) United States Patent
Galgon et al.

(10) Patent No.: US 7,083,307 B2
(45) Date of Patent: Aug. 1, 2006

(54) LIGHT DIRECTING ASSEMBLY FOR PREVENTING LIGHT POLLUTION

(75) Inventors: William P. Galgon, Spartanburg, SC (US); Richard L. D'Andrea, Greenville, SC (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/999,225

(22) Filed: Nov. 30, 2004

(65) Prior Publication Data

US 2006/0114679 A1 Jun. 1, 2006

(51) Int. Cl.
*F21V 11/00* (2006.01)

(52) U.S. Cl. ..... 362/353; 362/391; 362/547; 362/439

(58) Field of Classification Search ..... 362/547, 362/351, 353, 433, 437, 439
See application file for complete search history.

(56) References Cited

U.S. PATENT DOCUMENTS

| | | | | |
|---|---|---|---|---|
| 1,696,875 | A | 12/1928 | Andersen | |
| 1,755,737 | A | 4/1930 | Kesselring | |
| 1,897,822 | A | 2/1933 | Rohrkasle | |
| 2,088,544 | A | 7/1937 | Braselton | |
| 2,134,788 | A | 11/1938 | Hitner | |
| 2,163,272 | A | 6/1939 | Deschere | |
| 2,257,366 | A | 9/1941 | Bates et al. | |
| 2,521,448 | A * | 9/1950 | Corcoran | 362/350 |
| 2,907,873 | A | 10/1959 | Smith | |
| 2,990,494 | A | 6/1961 | Liberman et al. | |
| 4,591,960 | A | 5/1986 | Jones | |
| 4,807,100 | A | 2/1989 | Hudimac | |
| 4,998,193 | A * | 3/1991 | Chuing-Hui | 362/414 |
| 5,329,438 | A | 7/1994 | Thompson | |
| 6,409,365 | B1 * | 6/2002 | Lin | 362/404 |

OTHER PUBLICATIONS

Hinkley Lighting Product Catalog; 2 pages; copyright 2002.
Seagull Product Catalog Photo, copyright 2001-2005.

* cited by examiner

*Primary Examiner*—Thomas M Sember
(74) *Attorney, Agent, or Firm*—Daniel G. Shanley; Mark S. Bicks; Alfred N. Goodman

(57) ABSTRACT

A light-directing assembly is coupled to a light-emitting lamp. The assembly includes an opaque light shield having a top wall with a first opening. The light shield further includes a side wall coupled to the top wall and defines a second opening at a bottom edge. A light-directing assembly also includes a resilient washer having a central aperture and an outer dimension smaller than an inner dimension of the side wall. The central aperture of the washer is coupled to and receives a portion of the light-emitting lamp through an interference fit. The first opening of the light shield receives a second portion of the light-emitting lamp. A top wall of the light shield is supported by the washer and surrounds the light-emitting lamp. Thus, light from the light-emitting lamp is directed from the light-emitting lamp only out of the light shield and through the second opening.

24 Claims, 1 Drawing Sheet

LIGHT DIRECTING ASSEMBLY FOR PREVENTING LIGHT POLLUTION

FIELD OF THE INVENTION

The present invention relates to a light-directing assembly for use with an electrical light fixture for preventing light pollution. More particularly, the invention relates to a light-directing assembly including a washer and light shield supported by a lamp in the fixture for preventing light from being emitted above a horizontal plane of a lamp-receiving enclosure in the fixture.

BACKGROUND OF THE INVENTION

A dark sky typically refers to a night time sky where numerous stars are visible, unobstructed by artificial light and/or cloud cover. Outdoor light pollution is generally described as the inefficient use of light emissions. Misdirected or un-channeled light extends from lamp assemblies in the horizontal and vertical directions; therefore resulting in artificial illumination of the night sky.

For indoor lighting fixtures, lampshades are often used to concentrate light in a particular direction, and to shield glare from ones eyes. Lampshades enhance our ability to see objects through light concentration and glare reduction. However, this basic concept is often not incorporated into many of our outdoor lighting fixtures. The reason for the lack of light concentration on outdoor lighting fixtures is mainly because traditional thinking reasoned that the installation of more outdoor lighting fixtures will make an area safer.

As our population increases and land development continues, many homeowners, city planners, and architects continue the unnecessary installation of multiple outdoor lighting fixtures for the illumination of streets, parking lots, and buildings. Therefore, as more light fixtures are installed, the night is slowly being turned into day, without calculating the consequences of light pollution.

The ramifications of light pollution include: economic losses, scientific impacts on both amateur and professional astronomers, and visual impairment. First, the unwarranted generation of electricity to produce over-illumination results in economic loss to homeowners and businesses. Next, illumination of the dark skies limits the ability of astronomical observatories to view celestial objects at night. Lastly, glare emanating from light fixtures drastically reduces visual acuity.

As stated above, traditional thinking supported the position that safety would be enhanced with increased outdoor lighting fixtures in a given area. However, more recently, traditional notions have been criticized, and progress is being made to change the former concepts. Mainly, this criticism points to the negative impacts of light pollution and the ability to illuminate designated areas by light concentration rather than the number of lights. As these notions have become more main stream within urban planning and development circles, a continually need has arisen for improving technologies for directing light emitting from lighting fixtures, for improving the overall performance of outdoor lighting, and for simultaneously reducing light pollution.

While there have been numerous prior attempts at controlling the direction of light from lamps, they have consistently been costly and complicated to manufacture, assemble, package, and use, and have not been easily adapted to work with a large number of different light fixtures. Examples of such prior assemblies are disclosed, for example, in the following U.S. Pat. No. 1,696,875 to Andersen; U.S. Pat. No. 1,755,737 to Kesselring; U.S. Pat. No. 2,134,788 to Hitner; 2,907,873 to Smith; and U.S. Pat. No. 5,329,438 to Thompson, the disclosures of which are hereby incorporated herein by reference.

Consequently, there is a continuing need to provide a light-directing assembly which can be used for new light fixtures and retrofitting existing light fixtures which improves quality of lighting, not quantity.

SUMMARY OF THE INVENTION

An object of the present invention is to provide a light-directing assembly for preventing glare, reducing light pollution, and conserving energy.

Another object of the present invention is to provide a light-directing assembly which is interchangeable with a plurality of light fixtures and can be used for retrofitting existing light fixtures.

A further object of the present invention is to provide a light-directing assembly which is relatively simple and inexpensive to manufacture, assemble, package, and use.

The foregoing objects are basically obtained by a light-directing assembly that is coupled to a light-emitting lamp. The assembly includes an opaque light shield having a top wall with a first opening. The light shield further includes a side wall coupled to the top wall and defines a second opening at a bottom edge. A resilient washer is disclosed having a central aperture and an outer dimension smaller than an inner dimension of the side wall. The central aperture of the washer is coupled to and receives a portion of the light-emitting lamp through an interference fit. The first opening of the light shield receives a second portion of the light-emitting lamp. A top wall of the light shield is supported by the washer and surrounds the light-emitting lamp. Thus, light from the light-emitting lamp is directed from the light-emitting lamp only out of the light shield and through the second opening.

The foregoing objects are also attained by a light-directing assembly that is coupled to a light-emitting lamp which is coupled to a mounting electrical fixture having a lamp socket therein. The assembly includes an opaque light shield having a top wall with a first opening. The light shield further includes a side wall coupled to the top wall and defines a second opening at a bottom edge. A resilient washer is disclosed having a central aperture and an outer dimension smaller than an inner dimension of the side wall. The central aperture of the washer is coupled to and receives a portion of the light-emitting lamp through an interference fit. The first opening of the light shield receives a second portion of the light-emitting lamp and the socket is adapted to receive the lamp therein. A top wall of the light shield is supported by the washer and surrounds the light-emitting lamp. Thus, light from the light-emitting lamp is directed from the light-emitting lamp only out of the light shield and through the second opening.

The foregoing objects are further attained by a light-directing assembly including a mounting electrical fixture and an electrical socket. The electrical socket has a recess for receiving a light-emitting lamp and is connected to the mounting fixture. The light-emitting lamp has a neck portion and a bulb portion. The neck portion is adapted for insertion into the recess. A substantially opaque light shield has a top wall with a lower engagement surface, a side wall, and a receiving end having a bottom edge. The top wall has a first opening, and the bottom edge defines a second opening. A washer has a top surface, a bottom surface, and a central aperture for engaging the neck portion of the light-emitting lamp. A lamp-receiving enclosure has a bottom wall which defines an opening for transmitting light and also has a substantially horizontal plane. The top surface of the washer supports the lower engagement surface of the top wall for positioning the light shield relative to the neck portion of the light-emitting lamp. Thus, light is substantially prevented from being emitted above the horizontal plane of the lamp-receiving enclosure.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
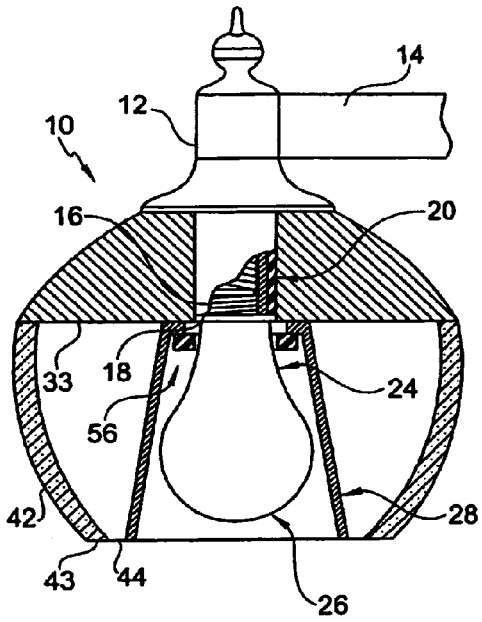
FIG. 1 is a front elevation view in partial-section of the light-directing assembly in accordance with the present invention.

Referring initially to FIGS. 1–4, a light-directing assembly 10 is coupled to a light-emitting lamp 22 which is connected to a mounting electrical fixture 12. The light-directing assembly 10 includes a light shield 28 having a top wall 30 with a first opening 48, and a side wall 34 coupled to the top wall 30 and defining a second opening 40 at a bottom edge 38. The light-directing assembly 10 also includes a resilient washer 56 having a central aperture 62 and an outer dimension smaller than an inner dimension of the side wall 34. The central aperture 62 of the washer is coupled to and receives a portion of the light-emitting lamp 22 through a resilient interference fit. The first opening 48 of the light shield 28 receives a second portion of the light-emitting lamp 22 above washer 56. The top wall 30 of the light shield 28 is supported by merely resting on and engaging the washer 56, and the top wall and side wall substantially surround the light-emitting lamp 22. Preferably, no part of the washer 56 is received in the first opening 48 in the top wall 30 of the shield 28 and no part of the washer 56 is physically attached to the top wall 30 to simplify construction, assembly, and use. A lamp-receiving enclosure 42 encloses the light-directing assembly 10 and has a bottom edge 43 which defines an opening for transmitting light therethrough and a substantially horizontal plane 44. Thus, light from the light-emitting lamp 22 is directed from the light-emitting lamp 22 only out of the light shield 28 and through the second opening 40.

In FIG. 1, a conventional mounting electrical fixture 12 is disclosed. The mounting fixture can be mounted on any suitable support structure including a wall, ceiling, post, or stanchion. The mounting fixture may be mounted in a horizontal or vertical orientation. Examples of conventional mounting fixtures are Progress Lighting Outdoor Lanterns, Catalog Nos.; 5627, 5777, 5762, 5664, 5763, and 5764. The mounting fixture includes a cable passageway 14 for running electrical cables and electrical power to the electrical socket 16.

The electric socket 16 includes top and bottom ends. The electric socket is connected to the mounting fixture by conventional fastening means. Preferably, the socket is cylindrical; however, it can be any suitable polygonal shape. The electric socket is a conventional socket having a recess 20 with internal right handed threads. The internal threads of the recess receive external threads of the light-emitting lamp 22. Electrical wires run from a power source through the cable passageway 14 to the electrical socket 16 for powering the light-emitting lamp 22.

Figure 2:
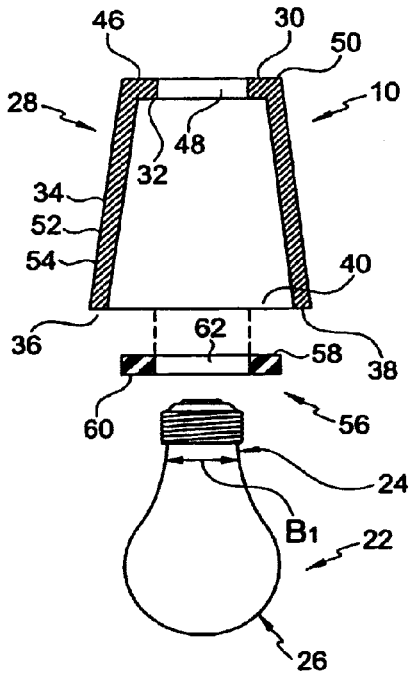
FIG. 2 is an exploded view of the light-directing assembly of FIG. 1 in accordance with the present invention.

As best seen in FIG. 2, the preferred light-emitting lamp 22 includes a neck portion 24 and a bulb portion 26. The neck portion 24 has an upper right handed threaded portion for insertion into a top end 18 of the internally threaded recess 20 of the electrical socket 16. The bulb portion 26 is substantially spherical and is located proximate and below the neck portion 24. Preferably, the light-emitting lamp 22 is a conventional 60–100 watt lamp; however, any standard lamp shape, configuration, and/or wattage may be used.

Figure 4:
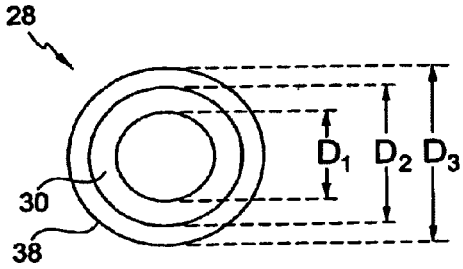
FIG. 4 is a top view of the light shield of FIG. 1 in accordance with the present invention.

As seen in FIGS. 1–2, and 4, a substantially unitary and rigid light shield 28 is disclosed. The light shield 28 is substantially opaque to light, and preferably substantially completely opaque to light. The light shield 28 is preferably made from a metal such as aluminum, but could be made from any suitable material including heat-resistant plastic. Preferably, the light shield 28 is substantially frustoconical in shape; however, any suitable polygonal shape could be used, such as cylindrical. The light shield 28 includes a substantially planar top wall 30 with a lower engagement surface 32, a side wall 34, and a receiving end 36 having a bottom edge 38. Once the lamp is installed in the fixture, the light shield 28 must be of sufficient size to fully surround and enclose the outer periphery of the light-emitting lamp 22, so that light can only be directed downwardly and below the bottom edge 38 of the light shield 28 through the second opening 40, i.e., not horizontally or upwardly. Preferably, light can only be directed through the second opening 40 below the horizontal plane 44 of the lamp-receiving enclosure 42. The top wall 30 is disposed on the upper smaller end 46 of the light shield 28. The top wall 30 has a substantially circular first opening 48 defining a first diameter $D_1$ and a circular outer edge defining a second diameter $D_2$.

The first opening 48 and the outer edge can be of any suitable polygonal shape; however, circular is preferred. The top wall 30 has a predetermined thickness and is substantially planar on both a top surface 50 and the lower engagement surface 32. The top wall 30 extends in a direction substantially parallel to the horizontal plane 44 of the bottom edge 43 of the lamp-receiving enclosure 42.

The side wall 34 is continuous. The side wall 34 has an inner surface 52 and an outer surface 54. The inner surface 52 or portions of the inner surface 52 may be coated with a reflective coating for facilitating light reflection and emission. The side wall 34 tapers upwardly and inwardly at an angle approximately sixty to eighty-five degrees towards a horizontal plane defined by the top wall 30. The receiving end 36 has a bottom edge 38 defining a second opening 40 and a third diameter $D_3$. The second opening 40 is preferably circular; however the second opening 40 may be any suitable polygonal shape.

As best seen in FIG. 4, the first diameter $D_1$ of the first opening 48 is smaller than the second diameter $D_2$ of the top wall 30 outer edge. The third diameter $D_3$ of the second opening 40 is larger than both the first diameter $D_1$ and second diameter $D_2$. If a polygonal shaped other than a circle is used, the same distances would apply for respective first, second, and third dimensions. Preferably, $D_1$, $D_2$, and $D_3$ are approximately the following dimensions; $D_1$=1 and ¼ inches, $D_2$=2 inches, $D_3$=3 inches, respectively. Additionally, preferably the length of the light shield 28 is approximately 3 and 7/16 inches. However, it should be understood that any dimension or combination of dimensions can be used.

Figure 3:
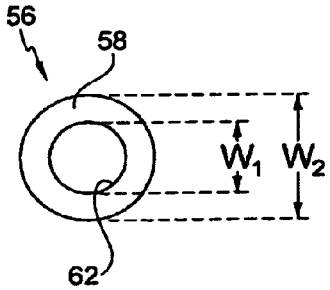
FIG. 3 is a top view of the washer of FIG. 1 in accordance with the present invention.

As seen in FIGS. 1–3, a substantially planar, disk-shaped, substantially annular and circular washer 56 is disclosed. The washer 56 may be of any suitable polygonal shape. The washer 56 is advantageously made of resilient material and can be made of any metal or plastic material; however, a rubber or neoprene material is preferable. Preferably, the material forming the washer is heat-resistant, and should be able to withstand temperatures of approximately 180° Celsius. The washer 56 has a top surface 58, a bottom surface 60, and a central aperture 62 for engaging the neck portion 24 of the light-emitting lamp 22. The central aperture 62 defines a first diameter $W_1$. The first diameter $W_1$ is slightly smaller than the lamp neck portion diameter $B_1$ and establishes an interference fit therewith when placed on the lamp. An outer edge of the washer defines a second diameter $W_2$. The second diameter $W_2$ is greater than the first diameter $W_1$. The washer first diameter $W_1$ is smaller than the light shield first diameter $D_1$. The washer second diameter $W_2$ is greater than the light shield first diameter $D_1$, but smaller than the light shield second diameter $D_2$. The first diameter $W_1$ is approximately 1 inch. The second diameter $W_2$ is approximately 1⅞ inches. The thickness of the washer is approximately ⅛ of an inch. However, it should be understood that any dimension or combination of dimensions can be used.

In FIG. 1, a conventional lamp-receiving enclosure 42 is disclosed. The lamp-receiving enclosure 42 is connected to the mounting fixture 12 by conventional fasteners, adhesives, or welding. In the preferred embodiment, the lamp-receiving enclosure 42 is substantially globe shaped and includes a bottom edge 43. The lamp-receiving enclosure 42 can be any polygonal shape (e.g. hexagon, pentagon, heptagon, octagon, etc.). At least portions of the lamp-receiving enclosure 42 are made of a light-translucent material. The translucent material may be divided by structural supports or can be solely supported by the mounting fixture 12. The bottom edge 43 of the lamp-receiving enclosure 42 defines the horizontal plane 44 below which the light-emitted from the light-emitting lamp 22 is directed.

Assembly and Operation

As described above, the present invention relates to an interchangeable and retrofittable light-directing assembly 10 for preventing light pollution on existing and new mounting fixtures 12. More particularly, the light-directing assembly 10 includes a separate washer 56 and light shield 28 for preventing light from being emitted above the horizontal plane of the lamp-receiving enclosure 42.

The light-directing assembly 10 is assembled as follows. First, the neck portion 24 of the lamp 22 is inserted through the central aperture 62 of the resilient washer 56. The light-emitting lamp 22 is inserted until a resilient interference fit is established between the inner wall of the central aperture 62 and the outer surface of the bulb 26 of the light-emitting lamp 22. Consequently, the washer 56 is releasably retained on the light-emitting lamp 22 by the interference fit. Next, the receiving end 36 of the light shield 28 is placed over and onto the washer 56 and over the light-emitting lamp 22 until a part of the neck portion 24 extends through the first opening 48 of the light shield top wall 30. The neck portion top part 24 is then screwed into the electrical socket recess 20.

As the neck portion 24 is tightened, the top surface 58 of the washer 56 is drawn into a tighter engagement with the lower engagement surface 32 of the light shield top wall 30. The neck portion 24 is continually tightened until the lower engagement surface 32 firmly abuts the top surface 58 of the washer 56, the top wall 30 of the light shield 28 is drawn contiguous and into engagement with the outer surface of the electrical socket 16, or the bottom wall 33 of the fixture 12 and the light shield 28 is secured relative to the light-emitting lamp 22. At this point, all or substantially all portions of the light-emitting lamp 22 are positioned above the bottom edge 38 and second opening 40 of the light shield 28.

Consequently, light emitting from the light-emitting lamp 22 can only escape through the light shield second opening 40 and is concentrated downwardly. The opaque light shield side wall 34 prevents light emission in the horizontal direction, while a reflective coating on the side wall also contributes to light distribution downwardly. Moreover, the light shield top wall 30 and the washer 56 prevent light from escaping upwardly by closing off any gaps around the neck portion 24 of the light-emitting lamp 22. If desired, the light shield 28 can be of such a length that the bottom edge 38 is parallel to the horizontal plane defined by the bottom edge 43 of the lamp-receiving enclosure 42, although as shown in FIG. 1 this length is longer.

While various embodiments have been chosen to illustrate the invention, it will be understood by those skilled in the art that various changes and modifications can be made therein without departing from the scope of the invention as defined in the appended claims.

What is claimed is:

1. A light-directing assembly adapted to be coupled to a light-emitting lamp, the combination comprising:

a substantially opaque light shield having a top wall with a first opening therein and a side wall coupled to the top wall and defining a second opening at a bottom thereof; and a substantially heat-resistant, resilient washer having a central aperture and an outer dimension smaller than an inner dimension of said side wall, said washer central aperture adapted to receive and be coupled to a portion of the light-emitting lamp in an interference fit therein, said light shield first opening adapted to receive a second portion of the light-emitting lamp therein, and said light shield top wall being supported by said washer and substantially surrounding the light-emitting lamp, thereby directing light from the light-emitting lamp substantially only out of said light shield through said second opening at the bottom thereof.

2. A light-directing assembly according to claim 1, wherein said light shield has a substantially frustoconical side wall.

3. A light-directing assembly according to claim 1, wherein said light shield top wall is substantially planar.

4. A light-directing assembly according to claim 1, wherein said first opening is smaller than the outer dimension of said washer, and said washer is not received in said first opening.

5. A light-directing assembly according to claim 1, wherein said washer is made from rubber.

6. A light-directing assembly according to claim 1, wherein said light shield has a substantially frustoconical side wall, said top wall is substantially planar, and said washer is made from rubber.

7. A light-directing assembly adapted to be coupled to a light-emitting lamp, the combination comprising:

a mounting electrical fixture having a lamp socket therein;

a substantially opaque light shield having a top wall with a first opening therein and a side wall coupled to the top wall and defining a second opening at a bottom thereof; and a substantially heat-resistant, resilient washer having a central aperture and an outer dimension smaller than an inner dimension of said side wall, said washer central aperture adapted to receive and be coupled to a portion of the light-emitting lamp in an interference fit therein, said light shield first opening adapted to receive a second portion of the light-emitting lamp therein, said lamp socket adapted to receive the lamp therein, and said light shield top wall being supported by said washer and substantially surrounding the light-emitting lamp, thereby directing light from the light-emitting lamp substantially only out of said light shield through said second opening at the bottom thereof.

8. A light-directing assembly according to claim 7, wherein said light shield has a substantially frustoconical side wall.

9. A light-directing assembly according to claim 7, wherein said light shield top wall is substantially planar.

10. A light-directing assembly according to claim 7, wherein said top wall of said shield engages said mounting electrical fixture.

11. A light-directing assembly according to claim 7, wherein said first opening is smaller than the outer dimension of said washer, and said washer is not received in said first opening.

12. A light-directing assembly according to claim 7, wherein said washer is made from rubber.

13. A light-directing assembly according to claim 7, wherein said light shield has a substantially frustoconical side wall, said top wall is substantially planar, and said washer is made from rubber.

14. A light-directing assembly, comprising:

a mounting electrical fixture;

an electrical socket having a recess for receiving a light-emitting lamp and being connected to said fixture, the light-emitting lamp having a neck portion and a bulb portion, said neck portion adapted for insertion into said recess;

a substantially opaque light shield including a top wall with a lower engagement surface, a side wall, and a receiving end having a bottom edge, said top wall having a first opening, and said bottom edge defining a second opening;

a washer having a top surface, a bottom surface, and a central aperture for engaging the neck portion of the light-emitting lamp;

a lamp-receiving enclosure having a bottom wall defining an opening for transmitting light therethrough and a substantially horizontal plane; and said top surface of said washer supports said lower engagement surface of said top wall for positioning said light shield relative to said neck portion of said light-emitting lamp for substantially preventing light from being emitted above said horizontal plane of said lamp-receiving enclosure.

15. A light assembly according to claim 14, wherein a diameter of the light-emitting lamp adjacent said neck portion is slightly smaller than a diameter of said lamp-receiving aperture, and said diameter of said lamp-receiving aperture is smaller than said top wall first opening, and said washer is not received in said first opening.

16. A light assembly according to claim 14, wherein said washer is resilient.

17. A light assembly according to claim 14, wherein said washer is made from rubber.

18. A light assembly according to claim 14, wherein said washer is made from neoprene.

19. A light assembly according to claim 14, wherein said washer is adapted to withstand temperatures of about 180° Celsius.

20. A light assembly according to claim 14, wherein said light shield is made from aluminum.

21. A light assembly according to claim 14, wherein said light shield side wall has an inner surface having a reflective surface coating thereon.

22. A light assembly according to claim 14, wherein said shield side wall is continuous.

23. A light assembly according to claim 14, wherein said lamp-receiving enclosure is translucent.

24. A light assembly according to claim 14, wherein said recess has internal threads for threadedly engaging threads on said neck portion of said lamp.

* * * * *